252-99 AU 166 EX

5/20/80 KR 4,203,852

United States Patent [19]

Johnson et al.

[11] 4,203,852

[45] May 20, 1980

[54] SOFTENER, BLEACH AND ANTI-CLING COMPOSITION

[75] Inventors: James R. Johnson, Highland Park; William Chirash, New Providence, both of N.J.

[73] Assignee: Colgate-Palmolive Company, New York, N.Y.

[21] Appl. No.: 750,325

[22] Filed: Dec. 13, 1976

Related U.S. Application Data

[63] Continuation of Ser. No. 672,095, Mar. 31, 1976, abandoned, which is a continuation of Ser. No. 447,140, Mar. 1, 1974, abandoned.

[51] Int. Cl.[2] ..... D06M 11/04; D06M 13/10; D06M 13/34

[52] U.S. Cl. ..... 252/8.8; 252/97; 252/98; 252/99; 252/8.75

[58] Field of Search ..... 252/8.8, 97–99, 252/102, 8.75

[56] References Cited

U.S. PATENT DOCUMENTS

| | | | |
|---|---|---|---|
| 3,003,954 | 10/1961 | Brown | 252/8.8 |
| 3,265,624 | 8/1966 | Inamorato | 252/102 |
| 3,353,902 | 11/1967 | Diamond et al. | 252/8.8 |
| 3,360,470 | 12/1967 | Wixon | 252/528 |
| 3,749,673 | 7/1973 | Jones et al. | 252/8.8 |
| 3,749,674 | 7/1973 | Jones et al. | 252/8.75 |
| 3,861,870 | 1/1975 | Edwards et al. | 252/8.8 |
| 3,897,347 | 7/1975 | Eckert et al. | 252/102 |
| 3,945,936 | 3/1976 | Lucas et al. | 252/102 |
| 4,045,358 | 8/1977 | Ramachandran | 252/102 |

OTHER PUBLICATIONS

Chem. Absts.: vol. 78: 98990f, "Quaternary $NH_4$ Salts in Detergents and Bleaches", Bright et al.

*Primary Examiner*—Edward M. Woodberry
*Attorney, Agent, or Firm*—Herbert S. Sylvester; Murray M. Grill; Norman Blumenkopf

[57] ABSTRACT

A wash cycle fabric softener, bleach and anti-cling composition compatible with organic detergents consisting essentially of a cationic softening agent, preferably a quaternary ammonium softener, and an inorganic peroxygen bleach compound in the weight ratio of 17:1 to 1:4 and preferably 10:1 to 1:1 of bleach:cationic.

8 Claims, No Drawings

SOFTENER, BLEACH AND ANTI-CLING COMPOSITION

This is a continuation of application Ser. No. 672,095 filed Mar. 31, 1976 which is in turn a continuation of application Ser. No. 447,140 filed Mar. 1, 1974, both now abandoned.

The present invention relates to a multifunctional fabric softener and bleach product that softens laundry items, reduces or eliminates static cling of synthetic fabrics and boosts the cleaning of laundry.

The use of various and diverse chemical materials, and particularly cationic compounds as softeners for textile products, is very well known in the art. It is also well known to employ such materials for their softening effect during the laundering operation and particularly in the rinse cycle of the laundering process. This technique has been necessitated by the fact that the softeners heretofore employed, being mainly cationic in nature, are not compatible with the major type of detergent used in the washing cycle. By far, the predominating type of detergent used in home laundering processes is anionic in nature. It has been found that even traces of anionic materials results in a precipitate which reduces the effectiveness of said cationic fabric softeners. This manifestation of incompatibility has necessitated the use of cationic quaternary softeners during laundering in the rinse cycle after several rinses to free said laundered fabrics of traces of anionic detergent.

Similarly, bleaching agents are customarily added to the laundry during the washing operation, as a separate step. Thus, it is apparent that two separate products and two separate additions were required in the laundering operation heretofore.

It has now been found that a multifunctional single product compatible with organic detergents can advantageously be added to the laundry during the wash cycle, comprising essentially a cationic softening agent and an inorganic peroxygen bleach. Instant composition, which is preferably in particulate form, provides softening, anti-static effects, enhances cleaning and stain removal to laundry treated therewith.

Accordingly, a primary object of this invention is the provision of a multifunctional product compatible with organic detergents inclusive of anionics and nonionics.

Still another object of this invention is to provide a fabric softening-bleach composition possessing anti-static properties.

Other objects will appear hereinafter as the description proceeds.

In accordance with the above objects, the fabric softener, bleach and anti-cling composition of this invention comprises a cationic softener and an inorganic peroxygen bleach compound in the weight ratio of 17:1 to 1:4 and preferably 10:1 to 1:1 of bleach:cationic.

The cationic fabric softening compounds useful in the composition of the present invention are commercially known and comprise cationic nitrogen containing compounds, such as quaternary ammonium compound and amines containing one or two straight chain organic radicals of at least 8 carbon atoms and preferably containing at least one straight chain organic radical containing from 12 to 22 carbon atoms.

Generally, the quaternary ammonium softening agents have the following formulae:

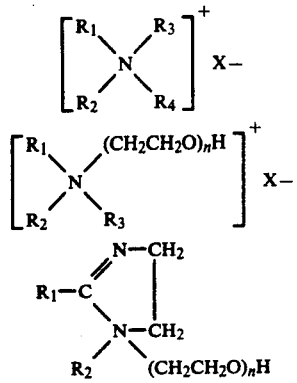

wherein $R_1$ is a long chain aliphatic radical having from 8 to 22 carbon atoms, $R_2$ is a long chained aliphatic radical having from 8 to 22 carbon atoms or is a lower alkyl radical having from 1 to 4 carbon atoms or an aryl or aralkyl radical, $R_3$ and $R_4$ are lower alkyl radicals, n is a number between 1 and 15 and X is a water soluble salt forming anion, such as a halide, i.e. chloride, bromide, iodide; a sulfate, acetate, hydroxide, methosulfate or similar inorganic or organic solubilizing monoor dibasic radical. Examples of quaternary ammonium softening agents suitable for use in the composition of the present invention include the following: hydrogenated ditallow dimethyl ammonium chloride, ethoxylated distearyl dimethyl ammonium chloride, 1-hydroxyethyl-1-methyl-2-heptadecyl imidazolinium chloride; dimethyl distearyl ammonium chloride; trimethyl stearyl ammonium bromide; cetyl trimethyl ammonium chloride, di-coco dimethyl ammonium chloride; cetyl pyridinium chloride; higher alkyl dimethyl benzyl ammonium chloride; diisobutyl phenoxy ethoxy ethyl dimethyl benzyl ammonium chloride; lauryl isoquinolinium bromide; distearyl dimethyl quaternary ammonium bromide; distearyl dimethyl quaternary ammonium methylsulfate; dimethyl arachidyl behenyl quaternary ammonium chloride; di(soya) dimethylammonium chloride, and benzyl dimethyl stearyl ammonium chloride, etc.

Examples of amines which may be utilized in the composition of the present invention include primary tallow amine, primary coco amine, primary halogenated tallow amine, n-tallow 1,3-propylene diamine, oleyl 1,3-propylene diamine, and coco 1,3-propylene diamine.

The term "coco" when utilized refers to fatty acid groups formed in coconut oil fatty acids. Such acids contain from about 8 to 18 carbon atoms per molecule predominating in the $C_{12-14}$ acid.

An essential ingredient in instant softening composition is an inorganic peroxygen bleaching compound. Any of the peroxide compounds conventionally employed in the art as bleaching agents are suitable for use herein with typical examples including, without necessary limitation, inorganic persalts such as typified by perborates, percarbonates, perphosphates, persilicates, persulfates, hydrogen peroxide, sodium peroxide and the like. As will be appreciated, specific circumstances may well serve to dictate the use of a specific type of peroxide compound, e.g., considerations associated with compatability, bleaching activity, active oxygen content etc. In any event, particularly beneficial results are obtained with the use of the alkali metal perborate such as sodium perborate, compounds of this type having been found to permit the attainment of optimum performance as regards bleaching capacity, concentration efficiency and the like.

Additionally, the present invention contemplates the employment of either or both of the cationic softner and peroxide compounds in admixture comprising two or more the advisability of so proceeding depending primarily upon the requirements of the processor. In any event, this particular expedient affords to the formulator effective means whereby to capitalize on the beneficial properties characterizing each of a plurality of cationic and/or peroxide compounds. When provided in the form of a simple bleach composition, the involved ingredients may comprise simply a mixture of the peroxide and cationic compound within the relative weight ratios stated. Other ingredients may be included in minor amounts i.e., from 0 to 5% and preferably from 0.1% to 3% by weight of composition such ingredients including without necessary limitation, phosphates to control pH, olfactory agents, optical brighteners and dyes etc. Where manufacture of the bleach composition in the form of a tablet is contemplated, materials such as typified by corn starch may be added to expedite breakup of the tablet. Optional ingredients of the foregoing type will be discussed hereinafter in greater detail.

Instant composition is particularly beneficial as regards capability of providing a fabric having a softer hand, improved absorbency, permanency of whiteness, superior stain removal, the elimination of static electricity in synthetics and the like. Discoloration and yellowing of fabrics as well as the curtailment of the useful life of fabrics normally associated with bleaching compounds upon aging is eliminated by instant composition.

Weight ratios of 10:1 to 1:1 of inorganic peroxygen bleach:cationic softener appear to be most effective as a superior multifunctional treating composition capable of yielding superior softness, bleaching and anti-cling properties to fabrics treated therewith. However, beneficial results have also been obtained, wherein the weight ratio of bleach:cationic softener is 17:1 to 1:4. Proportions of each ingredient may be varied to alter bleaching, softening and anti-static effects.

The process of treating fabrics with instant softening compositions is not dependent on temperature and performs well with either cold or warm laundering solutions. Also, the process can be conducted using water of any reasonable degree of hardness, although obviously, the use of softer wash water is preferred.

The softening-bleach and anti-cling composition of instant invention may also include minor amounts of brighteners, bluing, germicides, perfumes, diluents or other additives which do not interfere with the softening, whitening and anti-cling properties of said composition.

This product is preferably prepared by dry blending the ingredients to form a free-flowing powder. The peroxygen bleach and cationic softener, in particulate form, may be added to the wash water simultaneously with the organic detergent or built detergent; or may be dry blended with spray dried beads of detergent or built detergent prior to addition to the wash water. Instant product may be granular or powdered as well as formed into pellets or other suitable shape. The amount of cationic softener based on the total weight of the laundering composition may be 3-20% and the amount of peroxygen bleach may constitute about 5-50% and preferably 20-40% of the total weight.

The invention has found its greatest utility thus far in the softening and bleaching of cotton fabrics, fabrics made of other cellulosic fibers, e.g., rayon or other textile fibers, e.g. nylon, silk, wool, polyethylene terephthalate, cellulose acetate, acrylonitrile polymers or copolymers, or blends of any two or more of these fibers (e.g., cotton-polyester blends). This softening-bleach and anti-cling composition may be applied to the fabric in an aqueous bath, either during the wash cycle of laundering, or as a separate and distinct softening and bleach operation. Since this softening-bleach composition is compatible with anionic and non-ionic detergents, it is preferably added to the wash water during laundering. In use, 90 g of the softening-bleach composition is added to an automatic washing machine or similar treating both containing 17 gallons (35 liters) of water, and an average load of fabrics (about 6 to 8 pounds). However, lesser or greater amounts may be utilized to obtain the desired degree of softness, whiteness and anti-static properties, depending on the water temperature, the water hardness, the amount of water and clothes, etc.

The following examples are given to further illustrate this invention. All parts given are by weight unless otherwise indicated. In the Examples, the pressure is atmospheric unless otherwise indicated.

EXAMPLE 1

| Ingredients | % |
|---|---|
| 1. Arosurf TA-100 (softener) | 10% |
| Sodium Perborate | 25% |
| 2. Spray-Dried Base Beads | 65% |

1 A powdered product by Ashland Chemical Co., containing 94% minimum dimethyl distearyl ammonium chloride.

2. Contains 16.7% sodium silicate solids (1:2.35)
16.7% sodium carbonate
57.7% sodium sulfate
3.3% $C_{14}$-$C_{15}$ linear alcohol ethoxylate (11EO).
5.6 optical brighteners and moisture The individual components are dry mixed and the resultant composition is used in the laundering of fabrics. Several swatches of cotton terry towel, cotton PP and Polyester/cotton PP (PP=Permanent Press finish) are subjected to five consecutive 10 minute washes in water having a water hardness of 150 ppm at 120° F. with a heavy duty detergent comprising 10% sodium linear tridecyl benzene sulfonate, 2% $C_{14}$-$C_{14}$ fatty alcohol with an average of 11 ethylene oxide groups, 2% mixed sodium coconut/tallow fatty acid soap, 35% pentasodium tripolyphosphate, 7% sodium silicate ($Na_2O$:$Sio_2$ ratio 1:2.35), 0.5% sodium carboxymethyl cellulose and the balance sodium sulfate plus 90 grams of above composition.

The final softness rating of the swatches was 10++, on a scale from 1-10; where 1 represents no softness and 10 represents excellent softness, with a value of 5 being required for marginal softness and 8 representing desirable softness. The anti-static effect on the synthetic fabric was very good.

Comparison tests run with detergent alone, detergent plus softener, and detergent plus chlorox bleach gave the following results:

TABLE I

| Washing composition | Terry Towel Softness rating | Synthetic Fabric Anti-static effect |
|---|---|---|
| detergent and composition of Example 1 | 10++ | very good |
| detergent alone | 1 | nil |
| detergent + softener | 10 | fair - some cling |
| detergent + chlorox bleach | 5 | poor - strong cling |

In addition, the cleaning power and stain removal ability of the detergent was enhanced by the pressure of instant composition.

Thus, it is apparent that the conjoint use of the cationic softener, particularly the quaternary ammonium type, and the peroxygen bleach yields a totally unexpected synergistic cleaning effect, enhancing the softening properties thereof.

The weight ratio of peroxygen bleach to cationic softener herein is 2.5:1.

EXAMPLE 2

The Arosurf TA-100 content of Example 1 is reduced to 5%, the sodium perborate content is increased to 35%, and the spray dried base beads is reduced to 60%.

Fabrics treated in accordance with the procedure of Example 1 with this composition, which represents a weight ratio of bleach to softener of 7:1, exhibited a softness rating of 8, a very good anti-static effect and excellent stain removal.

Thus, it is apparent that varying the ratio of bleach to softener within certain limits yields varying degrees of softness and stain removal.

EXAMPLE 3

The washing procedure of Example 1 was followed except that the fabric was subjected to one ten minute wash cycle, utilizing 95 g of aforedefined heavy-duty detergent plus 10 g softener and 20 g sodium perborate (a ratio of bleach to cationic of 2:1) on various stains using 4 swatches stained with blueberry pie filling, 4 swatches stained with clay, 4 swatches stained with potting soil, 1 strip of multi-stain fabric and 4 terry towels, with the following results:

The effectiveness of stain removal is determined by reflectance readings, Rd (anti-redeposition) on the fabric, using a Gardner Color Difference meter, wherein higher Rd values is indicative of increased whiteness; Rb (fluorescence) measures brightness with higher values indicating greater whiteness, a=redness (+), green (−); and b=blueness (−), yellow (+).

TABLE II

| Stain | Composition | Rd | a | b | Rb | Softness rating |
|---|---|---|---|---|---|---|
| Blueberry pie filing | detergent + softener | 71.6 | −1.4 | 3.4 | | |
| Blueberry pie filing | detergent + 2:1 perborate: softener | 79.8 | −0.9 | +5.4 | | |
| Clay | detergent + softener | 69.9 | +3.3 | +10.4 | | |
| Clay | detergent + 2:1 perborate: softener | 73.7 | +2.6 | +9.4 | | |
| Potting soil | detergent + softener | 79.0 | −0.5 | +6.2 | | |
| Potting soil | detergent + 2:1 perborate: softener | 76.5 | −1.0 | +4.7 | | |
| Terry Towels | detergent + softener | 91.0 | +1.1 | −2.0 | 291 | 10 |
| Terry Towels | detergent + 2:1 perborate: softener | 92.4 | +1.4 | −3.0 | 321 | 8 |
| Multistain Strip | | | | | | |
| Bleached Greige | detergent + softener | 88.1 | −1.0 | +2.4 | | |
| Bleached Greige | detergent + 2:1 bleach: softener | 88.6 | −1.0 | +2.1 | | |
| Bleached Oily | detergent + softener | 36.8 | +0.3 | +3.6 | | |
| Bleached Oily | detergent + 2:1 bleach: softener | 41.8 | +0.2 | +3.7 | | |
| Hemoglobin | detergent + softener | 60.9 | +1.2 | +9.4 | | |
| Hemoglobin | detergent + 2:1 bleach: softener | 37.2 | +2.9 | +13.0 | | |
| CMS (Coco, milk, sugar) | detergent + softener | 47.8 | +5.4 | +9.7 | | |
| CMS (Coco, milk, sugar) | detergent + 2:1 bleach: softener | 50.2 | +5.3 | +9.2 | | |
| BMI (blood, milk, ink) | detergent + softener | 31.0 | 0.0 | +3.3 | | |
| BMI (blood, milk, ink) | detergent + 2:1 bleach: softener | 17.3 | +0.2 | +3.2 | | |
| Oily | detergent + softener | 26.7 | −0.6 | −2.6 | | |
| Oily | detergent + 2:1 bleach: softener | 28.6 | −0.7 | −2.6 | | |
| **Stain** | **Composition** | **Rd** | **a** | **b** | **Rd** | **Softness rating** |
| Greige | detergent + softener | 71.4 | +1.0 | +11.8 | | |
| Greige | detergent + 2:1 bleach: softener | 72.0 | +0.8 | +11.8 | | |
| Red Wine | detergent + softener | 64.1 | +2.1 | +5.8 | | |
| Red Wine | detergent + 2:1 bleach: softener | 65.5 | +2.3 | +6.6 | | |

The above results clearly show superior cleaning and stain removal for most stains inclusive of clay stains, blue berry pie stains, red wine stains, coco, milk and sugar stains, and oily stains except for potting soil, blood, milk and ink stains.

EXAMPLE 4

A clean load of assorted fabrics was washed once in accordance with the procedure in Example 1 and machine dried for 1 hour, using 95 g of the heavy detergent specified in Example 1 plus 110 g chlorox; 95 g detergent plus 90 g of the composition of Example 2; 95 g detergent plus 90 g of the composition of Example 1; and 95 g detergent plus 90 g cationic softener and the cleaning performance softener and anti-static properties thereof measured as shown in the following table:

TABLE III

| Composition | Fabric | Rd | a | b | Rb | Softness | Anti-static |
|---|---|---|---|---|---|---|---|
| detergent + chlorox | cotton | 92.0 | +0.9 | −3.1 | 287 | | poor- |
| | nylon | 87.6 | −0.9 | +2.3 | 059 | | very strong |
| | heavy dacron | | | | | | cling and |
| | cotton/PP | 87.7 | +0.2 | 0.0 | 184 | | static |
| | Terry Towels | 94.1 | +1.1 | −4.7 | 358 | 4 | |
| detergent + Example 2 | cotton | 92.1 | +1.0 | −3.3 | 302 | | very good |
| | nylon | 96.2 | +0.7 | +2.5 | 078 | | |
| | heavy dacron | | | | | | |
| | cotton/PP | 87.7 | +0.4 | −0.2 | 207 | | |
| | Terry towels | 92.0 | +0.9 | −2.9 | 339 | 8 | |
| detergent + softener | cotton | 92.0 | +0.9 | −2.7 | 275 | | fair- |
| | nylon | 87.3 | −1.4 | +2.4 | 053 | | some cling |
| | heavy dacron | | | | | | |
| | cotton/PP | 87.3 | +0.3 | +0.3 | 177 | | |
| | Terry towels | 91.7 | +0.8 | −2.6 | 327 | 10+ | |
| detergent + Example 1 | cotton | 91.9 | +0.9 | −3.4 | 297 | | very good |
| | nylon | 96.1 | +1.0 | +2.7 | 066 | | |
| | heavy dacron | | | | | | |
| | cotton/PP | 89.8 | 0.0 | 0.0 | 199 | | |
| | Terry towels | 92.1 | +0.8 | −3.0 | 340 | 10++ | |

The overall performance of the compositions of instant invention was good with superior qualities in a, b, Rb, softness and anti-static properties exhibited by the composition of Example 1.

EXAMPLE 5

To the composition of Example 1 was added 0.2% lemon tang perfume and the content of spray dried base beads was adjusted accordingly. Fabrics treated herewith exhibited superior whiteness, softness and anti-static properties.

EXAMPLE 6

To the composition of Example 2 was added 0.2% lemon tang perfume and the content of the spray dried base beads was adjusted accordingly. This product also yielded superior bleaching, softening and anti-cling properties.

EXAMPLE 7

Sodium percarbonate was substituted for the sodium perborate content of Example 5 with the same beneficial results as with the perborate-containing composition.

EXAMPLE 8

Sodium percarbonate was utilized in lieu of the sodium perborate component of Example 6. Similarly good results were obtained herewith with regard to whitening, softening and anti-cling properties.

EXAMPLE 9

| Ingredients | % |
|---|---|
| Sodium perborate | 25.0 |
| Arosurf TA-100 | 15.0 |
| Base beads | 60.0 |

EXAMPLE 10

| Ingredients | % |
|---|---|
| Sodium Perborate | 35.0 |
| Arosurf TA-100 | 8.0 |
| Base beads | 57.0 |

Instant products exhibit good shelf properties at room temperature with no visible caking after 14 days aging, good flowability, no degradation as evidenced by no odor or color change. In addition, the beneficial performance of instant products are continuous as evidenced by increased whiteness, softness and anti-cling properties exhibited by fabrics after 5 washes as compared to one wash.

While various preferred embodiments of the present invention have been illustrated by means of specific examples, it is to be understood that the present invention is in no way to be deemed as limited thereto, but should be construed as broadly as all or any equivalents thereof.

What is claimed:

1. A wash cycle fabric softener, bleach, and anti-cling powder, granular, pelleted or tabletted composition compatible with organic detergents consisting essentially of an inorganic peroxygen bleach compound blended with a cationic softening agent selected from the group consisting of hydrogenated ditallow dimethyl ammonium chloride, ethoxylated distearyl dimethyl ammonium chloride, dimethyl distearyl ammonium chloride, dimethyl distearyl ammonium bromide, dicoco dimethyl ammonium chloride, dimethyl arachidyl behenyl ammonium chloride, and disoyadimethyl ammonium chloride, in the weight ratio of 17:1 to 1:4 bleach to softening agent.

2. A composition in accordance with claim 1, wherein the softening agent is dimethyl distearyl ammonium chloride.

3. A composition in accordance with claim 2 wherein the peroxygen bleach is sodium perborate.

4. A composition in accordance with claim 1 wherein the peroxygen bleach is sodium percarbonate.

5. A composition in accordance with claim 1, wherein the peroxygen bleach is sodium perborate.

6. A composition in accordance with claim 1, wherein the peroxygen bleach is sodium percarbonate.

7. A method of simultaneously bleaching, softening and eliminating the cling properties of fabrics which comprises applying to said fabrics in an aqueous bath, an amount of the composition of claim 1, sufficient to bleach, soften and reduce the electrostatic properties of fabrics.

8. The method of claim 7, wherein the composition is applied in the wash cycle during laundering.

* * * * *